US006065935A

United States Patent [19]

Perfahl

[11] Patent Number: 6,065,935

[45] Date of Patent: May 23, 2000

[54] CYCLOIDAL PROPELLER HAVING BLADES WHICH MAY BE SET INTO A SAILING POSITION

[75] Inventor: Herbert Perfahl, Steinheim, Germany

[73] Assignee: Voith Hydro GmbH & Co. KG, Heidenheim, Germany

[21] Appl. No.: 08/931,852

[22] Filed: Sep. 16, 1997

[30] Foreign Application Priority Data

Sep. 17, 1900 [DE] Germany ..... 196 37 786

[51] Int. Cl.[7] ..... B63H 1/06

[52] U.S. Cl. ..... 416/156; 416/24; 416/98; 416/108; 416/111; 416/158; 416/170 R

[58] Field of Search ..... 416/24, 98, 108, 416/111, 112, 114, 155, 156, 158, 170 R

[56] References Cited

FOREIGN PATENT DOCUMENTS 1 941 652 2/1973 Germany .

3606549 A1 9/1987 Germany .

19602043 C1 3/1997 Germany .

OTHER PUBLICATIONS

Voith–Schneider–Propeller der intelligente Schiffsantrieb; pp.1–11.

*Primary Examiner*—Edward K. Look
*Assistant Examiner*—Ninh Nguyen
*Attorney, Agent, or Firm*—Randall J. Knuth

[57] ABSTRACT

The invention provides for a cycloidal propeller, in strictly rudder operation, accessory apparatuses that mesh with a gear drive connected to a shaft of the respective wing. The invention accomplishes relatively small actuation movements of the accessory apparatuses, sufficient to achieve a large pivoting movement of the wings, so that the wings can be adjusted over large angles without impediment. Therefore, wings having normal profiles may be utilized.

6 Claims, 4 Drawing Sheets

CYCLOIDAL PROPELLER HAVING BLADES WHICH MAY BE SET INTO A SAILING POSITION

BACKGROUND OF THE INVENTION

1. Field of the Invention.

The invention relates a cycloidal propeller.

2. Description of the Related Art.

Cycloidal propellers serve mostly as marine major drives, but may be used also as an auxiliary drive, namely whenever especially high maneuverability is required. A cycloidal propeller is described in Voith reprint 9.94 2000. The wing mechanism serves to move the wings on the wing circle of the rotor in the necessary positions to both generate propulsion, and generate control forces. Feathering is effected by way of a central joystick, which is actuated by two servomotors arranged at right angles to one another. The rotor is generally powered via a gear drive comprising a bevel ring gear and a bevel pinion, frequently by a diesel engine.

DE-B 19 41 652 describes a cycloidal propeller serving only as marine auxiliary drive and which at cruising travel of the ship is operated exclusively as a rudder. Feathering of the individual wings is effected by suitable accessory apparatuses to a degree such that in the so-called nonbuoyant, i.e., nonpropelling sailing position, they are parallel to one another and can in this position be adjusted to the necessary angular position by rotation of the rotor element according to the required rotor position.

DE 36 06 549 concerns a variant of a cycloidal propeller, which features a multiple-part wing. Safe and reliable actuation of the individual wing parts requires special measures, to which end a gear drive is provided, since the pivoting direction of the wing parts is easy to bring about with a number of gear wheels.

DE 196 02 043 C1 is an older, unpublished document.

But the design of the cycloidal propeller, notably concerning the configuration of the propeller mechanism and attachment to the wing shaft, results in relatively short feathering paths of the wings. Therefore, it is not possible to bring the rounded head end of the wings in a forward direction of travel. Therefore, wing profiles are used that deviate from the usual shape and have an essentially oval shape. At certain states of travel this is unfavorable, however, for example when the ship travels within narrow channels, for example in harbors or in the skerries. In such states of travel, it is advantageous to drive the ship using the cycloidal propeller, and not the main drive, which is configured for a considerably higher speed. The high maneuverability of the cycloidal propeller is utilized here.

SUMMARY OF THE INVENTION

The invention includes a cycloidal propeller comprising a stator and a rotor mounted rotatably to the stator. The rotor having an axis of rotation and a plurality of wings having shafts pivotally mounted to the rotor with a swivel axis. The rotor axis of rotation and the swivel axes of the wings are substantially parallel to each other. A propeller mechanism is included for actuation of the wings using a joystick connected to the wings by a linkage.

An accessory apparatus is connected to the wings, causing actuation of the wings to a sailing position where the wings are parallel to each other. The accessory apparatus is also able to actuate the wings from a sailing position to a rudder position. A gear drive is also provided for engaging the accessory apparatus to the wings.

The objective of the invention is to create a cycloidal propeller with which large pivoting angles are possible so as to achieve sailing position, thus allowing the use of a normal wing profile that has a thicker, rounded head part and a more slender tail end.

Due to the inventional measure, relatively small actuating movements of the hydraulic cylinder enable large pivoting angles of the wings in conjunction with the gear ratio of the gear drive.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
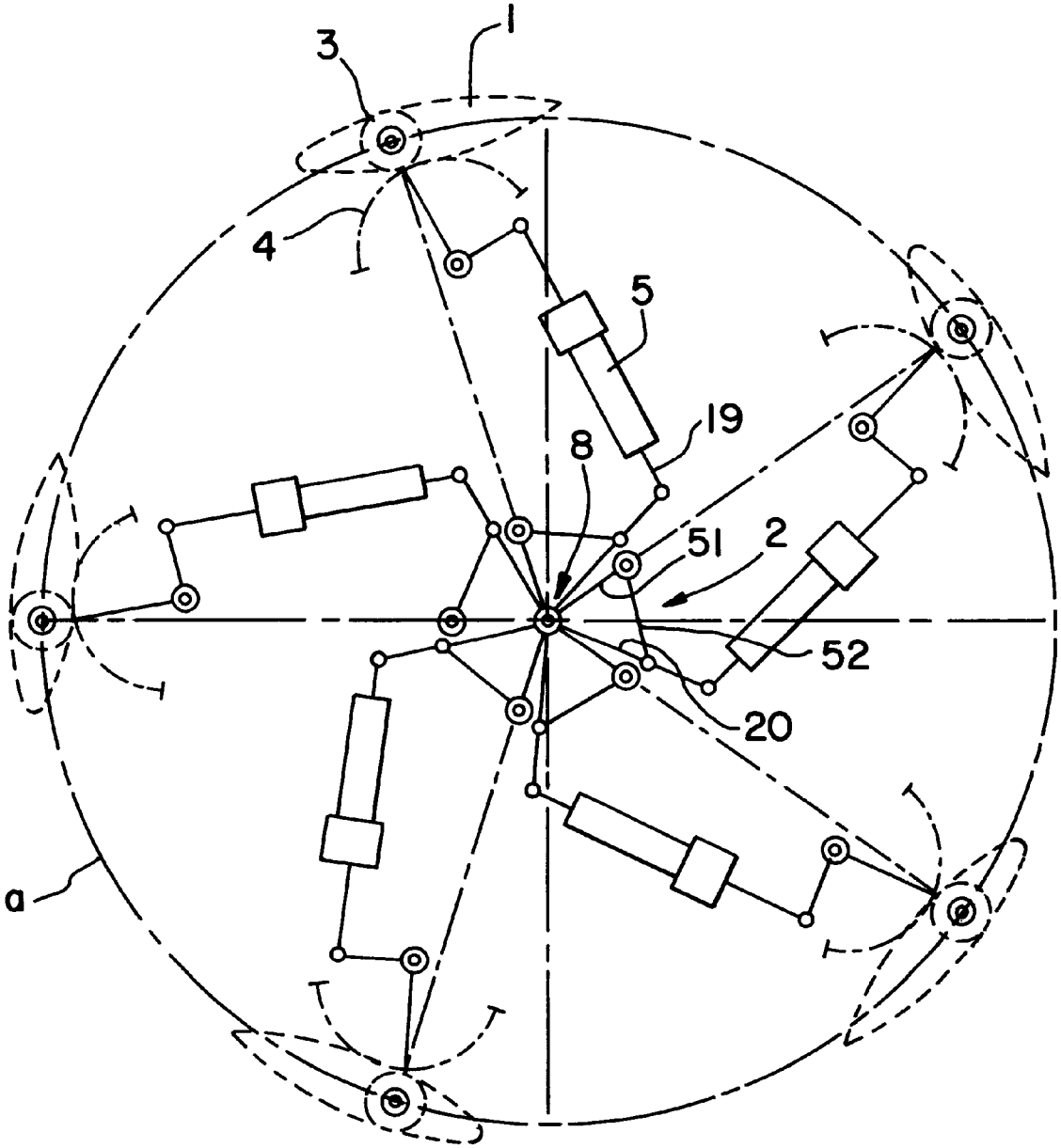
FIG. 1 is a basic plan view of the rotor of the cycloidal propeller with the propeller mechanism in normal position, i.e., for cruising operation.
Figure 2:
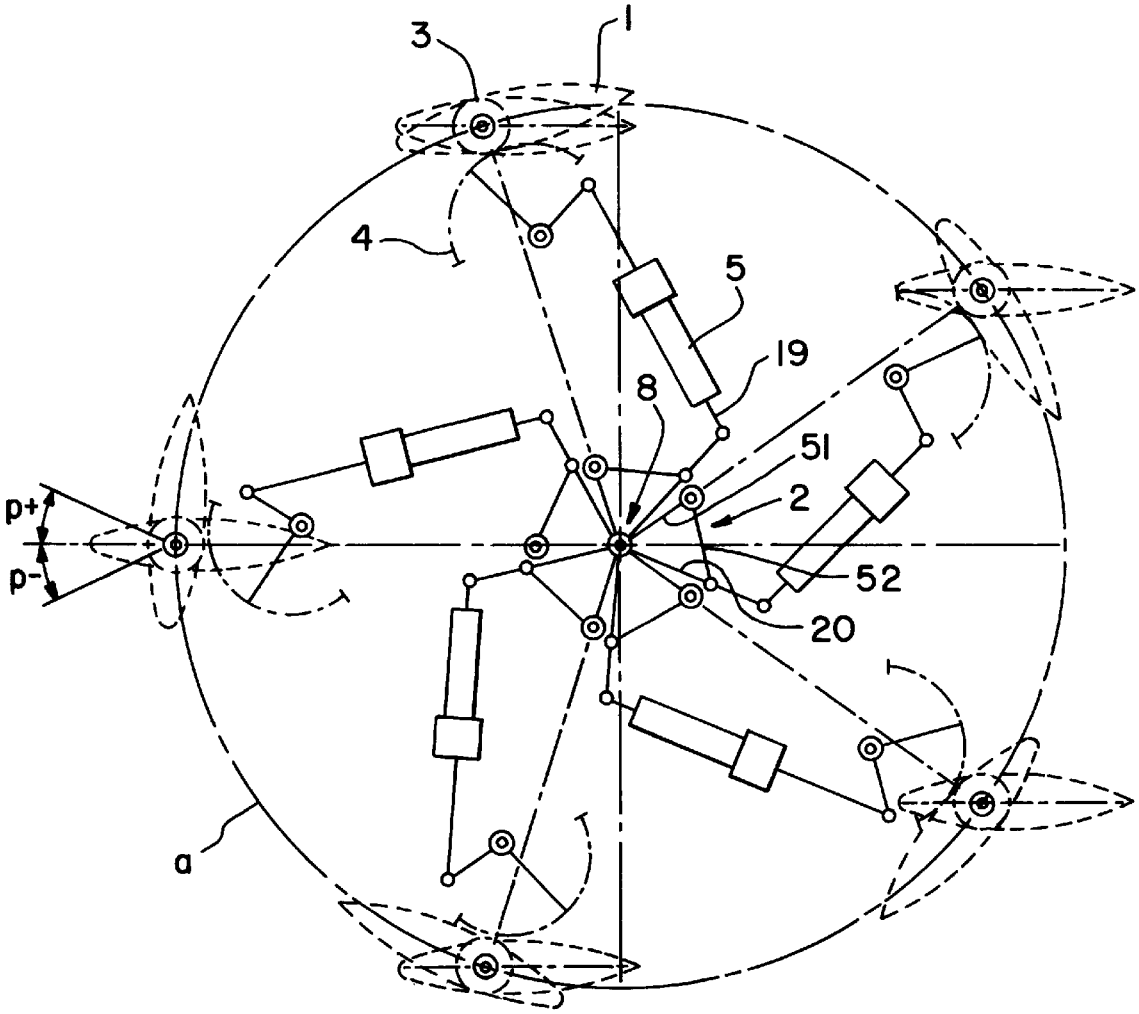
FIG. 2 is a corresponding view with the wings in sailing position.

Moving in cruising operation, i.e., propulsion of the ship, on wing circle a, wings are referenced 1 in FIG. 1. The propeller mechanism is referenced 2, the joystick being in the zero position, in which the profile chords extend generally tangentially to the wing circle a. Installed in the mechanism is a hydraulic cylinder 5 each, which here practically replaces most of coupling rod 19. The ram of the hydraulic cylinder is hinged to gear segment 4, which with its teeth meshes with the gear 3 mounted on the wing shaft.

Allowing appropriately large selection, the gear ratio of the gear drive produces a large pivoting angle of the wings.

To switch from cruising operation to rudder operation of the cycloidal propeller, the latter is shut off and locked at a specific spot, preferably with one of the wings, as shown here, on the rotor diameter that extends perpendicularly to the longitudinal axis of the ship. This provides a suitable basis for activating the individual wings accordingly with the hydraulic cylinder.

Figure 3:
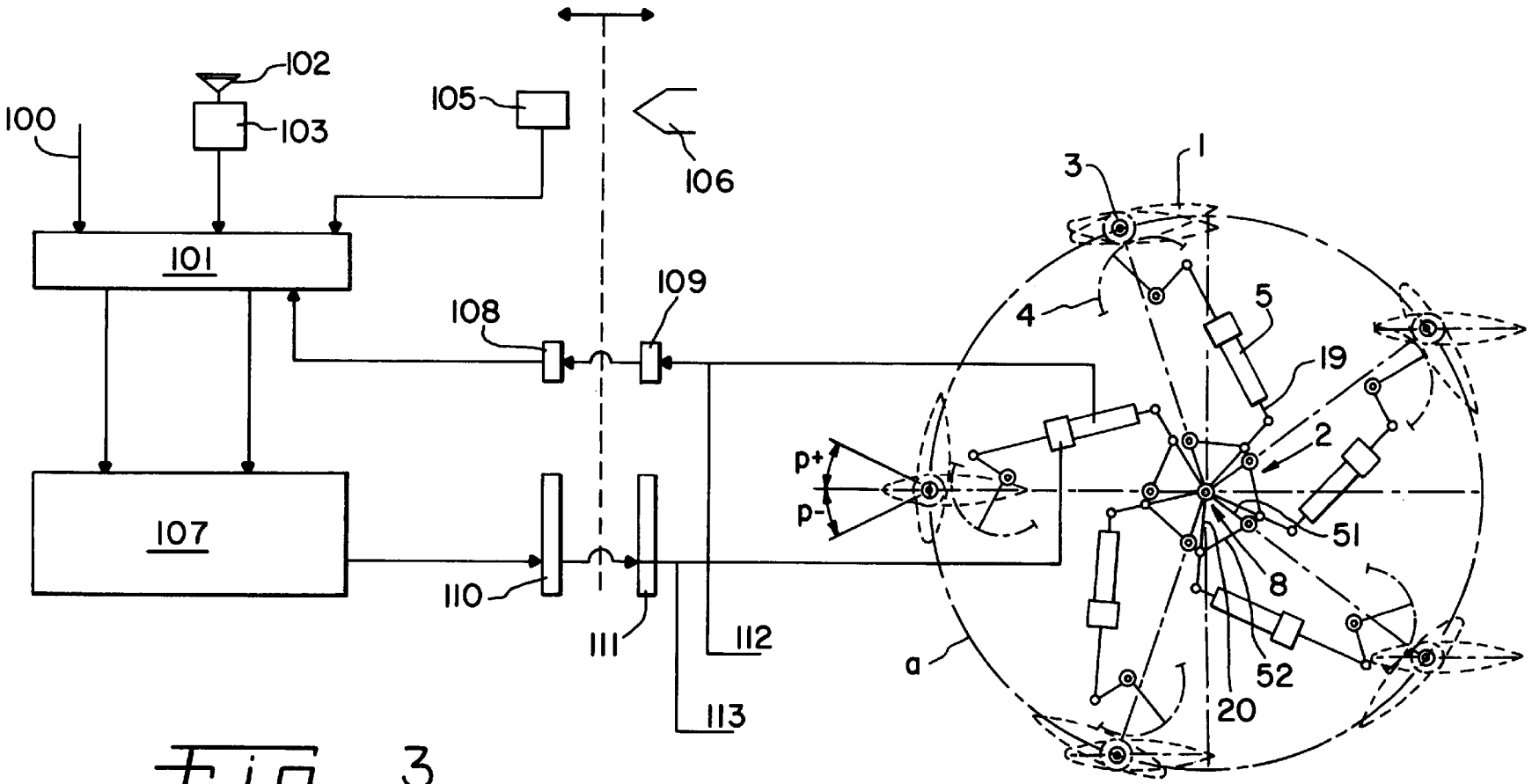
FIG. 3 is the controller in rudder operation (propeller with servo drive mechanism.
Figure 4:
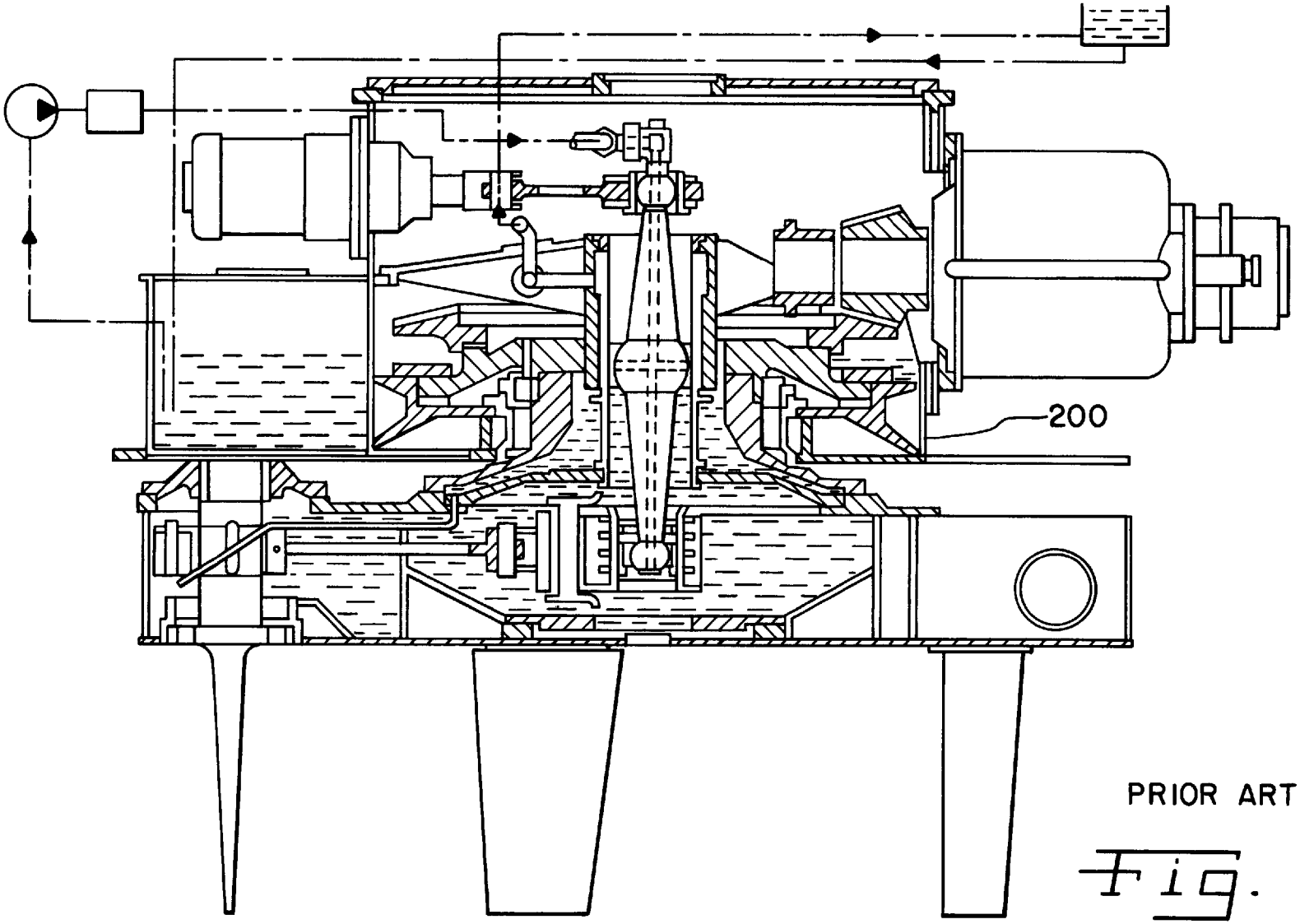
PRIOR ART Fig. 4
FIG. 4 is an elevetional view of a prior art cycloidal propeller with a stator 200.

FIG. 3 shows schematically a cycloidal propeller and the diagram of its controller. Major components are:

| | |
|---|---|
| 1 | Wing |
| 2 | Drive mechanism |
| 3 | Gear wheel (as part of the drive mechanism) |
| 4 | Gear segment |
| 5 | Hydraulic cylinder |
| 100 | Input from ship's compass |

-continued

| | |
|---|---|
| 101 | PLC control |
| 102 | Rudder wheel |
| 103 | Control signal generator (potentiometer) |
| 105 | Limit switch to lock rotor |
| 106 | Cam for locking rotor |
| 107 | Hydraulic fluid supply for hydraulic cylinders |
| 108 | Electric terminal on stator |
| 109 | Electric terminal on rotor |
| 110 | Hydraulic connection on stator |
| 111 | Hydraulic connection on rotor |
| 112 | Pitch feedback |
| 113 | Hydraulic fluid for hydraulic cylinder |

The connections of the controller diagram are illustrated a single wing, but they are identical for all five wings.

In normal propeller operation, hydraulic cylinders 5 are locked in the zero position and thus transmit the motions generated by the mechanism to the wings. An oil supply intergrated in the rotor compensates for leakage losses of the hydraulic cylinders, ensuring that their zero position is maintained always. Energy is supplied either via an accumulator, which is charged always at rotor standstill, or via an oil pump inshalled in the rotor and driven mechanically.

In the rudder operation, the rotor is at standstill. The quick-action couplings are now closed, establishing a connection of the hydraulic cylinders 5 to their respective oil supplies. In the simplest case, the quick-action couplings are closed manually. But the procedure can be automated easily (for example, by way of a hydraulically or pneumatically actuated apparatus. The same is true for the electrical connection to the displacement transducers contained in the hydraulic cylinder. Here, too the electrical connection is required not until the rotor is at standstill.

DESCRIPTION OF WHEEL ELEMENT BLOCKING

Stopping and blocking the rotor may be envisaged as follows:

The rotor features a cam for activation of a limit switch on the stator. As the propeller is shut down, the rotor stops at any point, but continues to be rotated then until the cam actuates the limit switch. Next, the propeller is locked against further rotation on the propeller input shaft, for example, by means of a disk brake or a plain mechanical lockout. The joystick is kept at a zero position by an electrically powered oil pump.

DESCRIPTION OF CONTROL

The propeller is, in normal operation, controlled via a known standard controller.

In the rudder operation, with the rotor at standstill, control is effected with the aid of a handwheel, which by means of a rotary potentiometer feeds control pulses to a stored program controller. The output signals control solenoid valves, which, in turn, effect the control of the hydraulic cylinders, and thus the required wing actuation. The control procedure can also be automated, using a signal from the ship's compass.

Accomplished with the proposed invention is a genuine sailing position, and additional rudder angles can be adjusted. That is, the propeller is thus a genuine substitute for an additional rudder, since all of the wings are rotated by a common angle, thus generating a thrust in a desired direction.

The overall system may be designed such that maximum wing deflections are given with the hydraulic cylinder rams in their limit positions.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A cycloidal propeller comprising:

a stator;

a rotor mounted rotatably to said stator, said rotor having an axis of rotation and a plurality of wings having shafts pivotally mounted to said rotor with a swivel axis, said rotor axis of rotation and said swivel axes of said wings substantially parallel to each other;

a propeller mechanism for actuation of said wings using a joystick connected to the wings by a linkage;

an accessory apparatus connected to said wings, said apparatus causing actuation of said wings to a sailing position where said wings are parallel to each other, said accessory apparatus able to actuate said wings from a sailing position to a rudder position; and a gear drive that engages said accessory apparatus to said wings.

2. The cycloidal propeller of claim 1 in which said accessory apparatus includes a hydraulic cylinder installed in said propeller mechanism.

3. The cycloidal propeller of claim 1 further comprising a thrust crank mechanism having a coupling rod with a center axis and a hydraulic cylinder, said hydraulic cylinder aligned with said center axis of said coupling rod.

4. The cycloidal propeller of claim 2, in which said gear drive includes:

a gear wheel having a central bore that coaxially circumscribes a wing shaft; and a driving gear segment to which said hydraulic cylinder is hinged.

5. The cycloidal propeller of claim 3, in which said gear drive includes:

a gear wheel having a central bore that coaxially circumscribes a wing shaft; and a driving gear segment to which said hydraulic cylinder is hinged.

6. A cycloidal propeller comprising a stator and, mounted rotatably therein, a rotor on which wings (1) are pivotally mounted;

a rotor axis of rotation and swivel axes of the wings extend parallel to one another and along a plane substantially defined by the wings;

a central joystick;

actuation of the wings (1) is effected by means of said central joystick (8) via a linkage (20, 51, 52) forming a propeller mechanism (2);

accessory apparatuses (5) are provided which at locked rotor cause an actuation of the wings (1) to a sailing position, in which the wings extend parallel to one another, and which apparatuses restore the wings from the sailing position to a rudder position; and said accessory apparatuses (5) engage the wings (1) via a gear drive (3, 4).

* * * * *